US008796616B2

(12) United States Patent
Wright et al.

(10) Patent No.: US 8,796,616 B2
(45) Date of Patent: Aug. 5, 2014

(54) MINIATURE MASS SPECTROMETER SYSTEM

(75) Inventors: Steven Wright, Horsham (GB); Christopher Wright, Stoke-on-Trent (GB)

(73) Assignee: Microsaic Systems PLC, Woking, Surrey (GB)

( * ) Notice: Subject to any disclaimer, the term of this patent is extended or adjusted under 35 U.S.C. 154(b) by 400 days.

(21) Appl. No.: 13/312,470

(22) Filed: Dec. 6, 2011

(65) Prior Publication Data

US 2012/0138790 A1 Jun. 7, 2012

(30) Foreign Application Priority Data

Dec. 7, 2010 (GB) ..... 1020728.0

(51) Int. Cl.
*H01J 49/26* (2006.01)
*H01J 49/10* (2006.01)

(52) U.S. Cl.
USPC ..... 250/288; 250/281; 250/282; 250/292; 250/396 R

(58) Field of Classification Search
USPC ..... 250/281, 282, 287–290, 299, 396 R, 250/397, 398, 423 R, 424, 425
See application file for complete search history.

(56) References Cited

U.S. PATENT DOCUMENTS

| | | | | |
|---|---|---|---|---|
| 5,466,932 | A * | 11/1995 | Young et al. | 250/289 |
| 7,667,193 | B2 * | 2/2010 | Finlay | 250/281 |
| 7,786,434 | B2 * | 8/2010 | Syms et al. | 250/288 |
| 7,960,693 | B2 * | 6/2011 | Syms et al. | 250/292 |
| 7,973,278 | B2 * | 7/2011 | Syms | 250/288 |
| 2003/0136905 | A1 * | 7/2003 | Franzen et al. | 250/292 |
| 2003/0197121 | A1 * | 10/2003 | Turecek et al. | 250/281 |
| 2005/0279931 | A1 | 12/2005 | Franzen et al. | |
| 2006/0076485 | A1 * | 4/2006 | Stoermer et al. | 250/290 |
| 2006/0124846 | A1 * | 6/2006 | Covey et al. | 250/288 |
| 2006/0163470 | A1 * | 7/2006 | Doroshenko et al. | 250/288 |
| 2008/0014656 | A1 * | 1/2008 | Thomson | 436/173 |
| 2009/0039283 | A1 * | 2/2009 | Franzen et al. | 250/425 |
| 2009/0090197 | A1 | 4/2009 | Finlay | |
| 2009/0212210 | A1 | 8/2009 | Finlay et al. | |
| 2012/0286150 | A1 * | 11/2012 | Muntean | 250/282 |
| 2012/0298853 | A1 * | 11/2012 | Kurulugama et al. | 250/282 |

FOREIGN PATENT DOCUMENTS

| | | | |
|---|---|---|---|
| DE | 4107794 | A1 | 9/1991 |
| EP | 2378539 | A2 | 10/2011 |
| GB | 2457708 | A | 8/2009 |
| GB | 2463149 | A | 3/2010 |
| WO | WO 96/11493 | | 4/1996 |

OTHER PUBLICATIONS

Yamashita, et al., Electrospray Ion Source. Another Variation on the Free-Jet Theme, J. Phys. Chem., Nov. 20, 1984, 4451-4459, vol. 88.

(Continued)

*Primary Examiner* — Bernard E Souw
(74) *Attorney, Agent, or Firm* — Bishop Diehl & Lee, Ltd.

(57) ABSTRACT

A miniature mass spectrometer that may be coupled to an atmospheric pressure ionisation source is described. Ions pass through a small orifice from a region at atmospheric pressure or low vacuum, and undergo efficient collisional cooling as they transit a very short, differentially pumped ion guide. A narrow beam of low energy ions is passed through a small aperture and into a separate chamber containing the mass analyser.

26 Claims, 17 Drawing Sheets

(56) References Cited

OTHER PUBLICATIONS

Wright, et al., MEMS-Based Nanospray-Ionization Mass Spectrometer, Journal of Microelectromechanical Systems, Dec. 2010, 1430-1443, vol. 19, No. 6.

Olivares, et al., On-Line Mass Spectrometric Detection for Capillary Zone Electrophoresis, Analytical Chemistry, Apr. 15, 1987, 1230-1232, vol. 59, No. 8.

Laughlin, Brian C., et al., "Atmospheric Pressure Ionization in a Miniature Mass Spectrometer." Analytical Chemistry, vol. 77, No. 9, pp. 2928-2939, May 1, 2005.

Malcolm, Andrew, et al., "A Miniature Mass Spectrometer for Liquid Chromatography Applications." Rapid Communications in Mass Spectrometry, vol. 25, No. 21, pp. 3281-3288, Nov. 15, 2011.

Gao, Liang, et al., "Breaking the Pumping Speed Barrier in Mass Spectrometry: Discontinuous Atmospheric Pressure Interface." Analytical Chemistry, vol. 80, No. 11, pp. 4026-4032, Jun. 1, 2008.

Great Britain Search Report for Application No. GB1020728.0, dated Mar. 31, 2011.

* cited by examiner

MINIATURE MASS SPECTROMETER SYSTEM

CROSS-REFERENCE TO RELATED APPLICATIONS

This application claims the benefit of Great Britain Patent Application No. GB 1020728.0 filed on Dec. 7, 2010.

TECHNICAL FIELD OF THE INVENTION

The present application relates to a miniature mass spectrometer system and in particular, to a system that may be coupled to an atmospheric pressure ionisation source. Typically, electrospray ionisation and chemical ionisation are used to generate ions at atmospheric pressure. A sample for analysis is often presented as a solution of one or more analytes in a solvent. The invention more particularly relates to an advantageous system architecture that maximises the sensitivity achievable with small vacuum pumps. The gas load that must be pumped at high vacuum is limited by the use of a differentially pumped chamber containing a very short ion guide. The ion guide is used to transmit the ion flux to the mass analyser with high efficiency.

BACKGROUND OF THE INVENTION

Mass spectrometry is a technique used in the field of chemical analysis to detect and identify analytes of interest. The sample must first be ionised so that components may then be acted upon by electric fields, magnetic fields, or combinations thereof, and subsequently detected by an ion detector. Mass analysers are operated at low pressure to ensure that the trajectories of the ions are dominated by the applied fields rather than by collisions with neutral gas molecules. However, it is often convenient to use an ion source operating at atmospheric pressure. Consequently, neutral gas molecules and entrained ions from the source must be drawn into the vacuum system through a small aperture. Atmospheric pressure chemical ionisation (APCI) and electrospray ionisation (ESI) are two common examples of such sources that are in widespread use.

The size and weight of a conventional atmospheric pressure ionisation (API) mass spectrometer is dominated by the pumping system, which is designed to maximise the amount of gas and entrained ions that can be drawn through the inlet, and at the same time maintain the pressure in the region of the mass analyser at a level consistent with its proper operation. A conventional bench-top instrument typically weighs approximately 100 kg and is coupled via a bulky vacuum hose to a floor-standing rotary pump, weighing an additional 30 kg. The power consumption can be more than a kilowatt, and relatively high levels of heat and noise are generated.

In vacuum systems, the flow of gas, Q, is given by $$Q=SP \quad \text{(Eq. 1)}$$

where S is the speed of the pump, and P is the pressure. There are many different types of vacuum pumps, but in all cases the pumping speed is related to the size and weight of the pump. According to Eq. 1, a large pump is required to simultaneously achieve low pressure and high gas throughput.

Prior to the widespread adoption of turbomolecular pumps, oil diffusion pumps and cryo pumps were used to achieve the high vacuum conditions required for mass spectrometry. Oil diffusion pumps are mechanically simple, dissipate a lot of heat, must be mounted in the upright position, are usually water cooled, and operate with a foreline (backing) pressure of less than 1 Torr. Cryopumps offer very large pumping speeds but require a supply of liquid nitrogen, or a bulky helium compressor. Turbomolecular pumps are mechanically complex and consequently relatively expensive. However, they are compact, generally air cooled, and can be mounted in any orientation. In addition, small and medium sized turbomolecular pumps tolerate a high foreline pressure.

Pumps capable of achieving low and medium vacuum pressures are needed for initial evacuation, direct pumping of vacuum interfaces, and providing foreline pumping. Such pumps are often referred to as roughing pumps, or backing pumps when used for foreline pumping. Oil-filled rotary vane pumps are universally used in conventional instruments. These are typically heavy, bulky, noisy, and require frequent servicing. Consequently, they are not housed within the main body of the instrument. Very lightweight and compact diaphragm pumps are available for low gas load applications. Although often used to provide foreline pumping for small turbomolecular pumps, they are not suitable for direct pumping of vacuum interfaces operating at or near 1 Torr.

Early system architectures, designated as Type A and Type B, are shown in FIGS. 1 and 2, respectively. In FIG. 1, gas and entrained ions from the atmospheric pressure ion source pass directly into the analysis chamber via an inlet orifice. A large high vacuum (HV) pump is required to pump the full gas load at the low pressure required for proper operation of the mass analyzer. The pressure in the foreline must be maintained at an intermediate pressure by a roughing pump, as high vacuum pumps cannot exhaust directly to atmospheric pressure. Even with a relatively large high vacuum pump, the orifice needs to be very small to limit the gas flow to a manageable level. For example, a 25 μm diameter inlet orifice requires a high vacuum pump with a speed of approximately 1000 L/s.

In FIG. 2, differential pumping is used to partly separate the tasks of pumping large volumes of gas and achieving the low pressures required by the mass analyser. A larger inlet orifice can be tolerated as the majority of the gas load is pumped at a relatively high pressure by the first chamber pump. Electrostatic lenses are used to focus the ions towards the inter-chamber aperture, thereby substantially increasing the concentration of ions in the gas flowing into the second chamber. However, the distance between the inlet orifice and the inter-chamber aperture must be kept short as ions are scattered when they collide with neutral gas molecules. The two high vacuum pumps are collectively less massive than the single pump that would be required if a Type A architecture had been adopted.

It was later appreciated that molecular beam techniques and principles could be applied in the design of API mass spectrometers [M. Yamashita and J. B. Fenn, J. Phys. Chem. 88, 1984, 4451-4459]. The general arrangement is shown in FIG. 3, and denoted as Type C. A portion of the gas flow through the inlet orifice is transferred to the second chamber through a skimmer that samples from the centre of the initial free jet expansion. The fraction of the total gas load transmitted by the skimmer is determined by the pressure in the first chamber, the area of the skimmer inlet, and its position relative to the inlet orifice. In the original embodiment of this idea, the first chamber was pumped to $10^{-3}$ Torr using a 1000 L/s diffusion pump, the inlet orifice was 70 μm in diameter, the skimmer was 4 mm in diameter, and the second chamber was pumped by two pumps with a total speed of 3000 L/s. Although a small fraction of the ions are transferred to the second chamber, the beam is well-collimated, which is ideal for efficient coupling to the mass analyser. Disadvantages of this arrangement are that large clusters and droplets can be transmitted through the skimmer, and free analyte ions condense with solvent or ambient water vapour during the adiabatic expansion.

An API mass spectrometer employing a differentially pumped radio frequency (rf) ion guide was described in 1987 [J. A. Olivares, N. T. Nguyen, C. R. Yonker, and R. D. Smith, Anal. Chem., 59, 1987, 1230-1232]. A schematic representation of this instrument is shown in FIG. 4, and designated as Type D. During the past twenty years, designs based on this architecture have been universally adopted by manufacturers of conventional instruments.

The trajectories of the ions are confined by an rf quadrupole ion guide as they transit the second chamber. In the case of a quadrupole ion guide, the field is generated by four rods arranged symmetrically about a common axis. The voltage applied to each rod is required to oscillate at rf, with the waveforms applied to adjacent rods having opposite phase.

The first chamber is operated at approximately 1 Torr, which is conveniently achieved with a rotary pump. As shown in FIG. 4, the same rotary pump can be used to pump the first chamber and provide foreline pumping for the two high vacuum pumps. At this pressure, the skimmer profile is much more critical, as the high gas density can result in a shock structure that disrupts the continuum flow of the jet. Typically, a skimmer with a 0.75-2.5 mm diameter inlet is located several millimeters downstream of a 200-350 μm diameter inlet orifice. An electrostatic lens can be placed around the skimmer to focus ions into its entrance, and thereby increase the ion-to-neutral gas ratio. In some systems, nearly all the ions are transmitted to the next stage. However, in view of the problems described in connection with FIG. 3, namely the formation of cluster ions and the transmission of droplets, some manufacturers have preferred to place a sampling orifice or cone downstream of the Mach disc, often in such a way that there is no line-of-sight trajectory from the inlet aperture. When this is the case, an electric field is applied so as to attract ions towards the sampling orifice or cone.

An alternative embodiment of the Type B architecture that incorporates an rf ion guide rather than electrostatic ion lenses is shown in FIG. 5, and designated as Type E. The first chamber contains an ion guide and is pumped to a pressure of $10^{-4}$-$10^{-2}$ Torr by a suitable high vacuum pump. Gas and ions pass through the inlet orifice whereafter the ion trajectories are constrained such that they may pass through the aperture between the first and second vacuum chambers.

Recently, one manufacturer has abandoned the traditional orifice-skimmer interface in favour of a short ion guide operating at high pressure. The arrangement is shown in FIG. 6 and designated as Type F. The size of the inlet orifice, the field radius of the first ion guide, and the pressure in the first chamber are chosen such that the free jet expansion is largely contained within the ion guide. A substantial fraction of the ion flux is captured and transmitted to the second vacuum chamber whereas the neutral gas escapes through the gaps between the rods. The first ion guide operates at a pressure of several torr, and as a result is followed by a second ion guide in the next vacuum chamber, which removes more of the gas load before the ions are mass analysed.

Increasingly, small, light-weight analytical instruments are required for industrial process monitoring, security applications, the detection of toxic or illicit substances, and deployment in remote or hazardous environments. In addition, the growing amount of equipment being used by analytical chemists in traditional laboratories has forced greater consideration of factors such as the linear bench space occupied by instruments, heat and noise generation, initial purchase price, and operational costs. Consequently, there is a need for a miniature API mass spectrometer that, although much smaller than a conventional system, is capable of a useful level of sensitivity. While the detection efficiency of a particular instrument depends on the details of its design, the ultimate sensitivity is limited by the amount of gas and entrained ions that can be drawn through the inlet. Unfortunately, even a modest scaling down of the system architecture used for conventional instruments results in a significant reduction in the gas load that can be tolerated. Accommodating all the pumps within a single, small enclosure is a particular difficulty, as the size and weight of the pumps commonly used to achieve intermediate vacuum do not scale favourably.

SUMMARY OF THE INVENTION

These and other problems are addressed by a mass spectrometer system in accordance with the teaching of the invention. The system can be constructed such that the ions produced by an API source pass through an inlet orifice and directly into a vacuum chamber containing an ion guide. In a preferred embodiment of the invention, this vacuum chamber is pumped with a turbomolecular pump with foreline pumping provided by a diaphragm pump. By avoiding the use of a rotary pump, the overall size and weight of the system can be substantially reduced.

In addition, it has been discovered that the phenomenon known as collisional cooling occurs with high efficiency in a miniature ion guide at much lower pressures than expected. The operating pressure is ideally achieved using a conventional turbomolecular pump, which must be coupled to the vacuum system with due consideration of the likely conductance limitations resulting from a short ion guide.

Accordingly, a miniature mass spectrometer system comprising a plurality of vacuum chambers is provided, the system further comprising:

a. an ion source operating substantially at atmospheric pressure and employing electrospray ionisation, microspray ionisation, nanospray ionisation, chemical ionisation, or derivatives thereof;

b. an rf ion guide provided within an ion guide vacuum chamber of the system, the ion guide defining a ion path between an entrance and exit to the ion guide vacuum chamber, the dimensions and geometry of the ion guide being such that apertures through which gas may escape from the ion guide have a total area less than 10 $cm^2$; and c. a mass analyser provided within a mass analyser vacuum chamber of the system;

wherein the vacuum chambers containing the rf ion guide and the mass analyser are operably pumped at a pressure lower than about $5\times10^{-2}$ Torr, other vacuum chambers of the system, where provided, being operably pumped at a pressure higher than about 50 Torr.

BRIEF DESCRIPTION OF THE DRAWINGS

The present application will now be described with reference to the accompanying drawings in which.

DETAILED DESCRIPTION OF THE INVENTION

It will be appreciated by those of skill in the art that, for instruments of a conventional size, a Type D architecture is overwhelmingly more preferable than a Type E architecture. For modern instruments, a typical inlet flow is 600 standard cubic centimeters per minute (sccm), and a typical ion guide pressure is $8\times10^{-3}$ Torr, so these parameters shall be adopted for the purposes of comparison. In Table (1), some characteristics of the turbomolecular pump needed to pump the chamber containing the ion guide, and the roughing pump required for the whole system are given. It has been assumed that the skimmer operates at 1 Torr and passes 10% of the gas load in the case of Type D, and that the foreline pressure required by a 950 L/s turbomolecular pump is 2 Torr in the case of Type E.

TABLE (1)

Pump characteristics for Type D and Type E architectures when the inlet flow is 600 sccm.

| | Type D | | | Type E | | |
|---|---|---|---|---|---|---|
| | Speed | Diameter | Weight | Speed | Diameter | Weight |
| HV pump | 95 L/s | 110 mm | 3-4 kg | 950 L/s | 250 mm | 20-40 kg |
| Roughing pump | 456 L/min | | 35 kg | 228 L/min | | 25 kg |

It can be seen and has been appreciated by those of skill in the art that a severe penalty of adopting a Type E architecture rather than a Type D architecture is that a much larger, heavier, and consequently, more expensive turbomolecular pump must be accommodated within the enclosure of the bench-top unit. It will also be appreciated that the diameter of the vacuum chamber must be approximately equal to the diameter of the pump in order that the effective pumping speed is not significantly compromised by a reducing connector. This results in further increases in the size, weight, and cost of the instrument. Recalling that the roughing pump is invariably floor-standing and coupled to the main instrument with a vacuum hose, it will be understood that the size and weight of this component is of less consequence.

If the flow through the inlet orifice is reduced to 50 sccm, the characteristics of the turbomolecular pump needed to pump the chamber containing the ion guide, and the roughing pump required for the whole system are as given in Table (2). It has been assumed that the skimmer operates at 1 Torr and passes 10% of the gas load in the case of Type D, and that the foreline pressure required by an 80 L/s turbomolecular pump is 10 Torr in the case of Type E.

TABLE (2)

Pump characteristics for Type D and Type E architectures when the inlet flow is 50 sccm.

| | Type D | | | Type E | | |
|---|---|---|---|---|---|---|
| | Speed | Diameter | Weight | Speed | Diameter | Weight |
| HV pump | 8 L/s | 45 mm | 2 kg | 80 L/s | 100 mm | 2.5 kg |
| Roughing pump | 38 L/min | | 10 kg | 3.8 L/min | | 1.6 kg |

Figure 1:
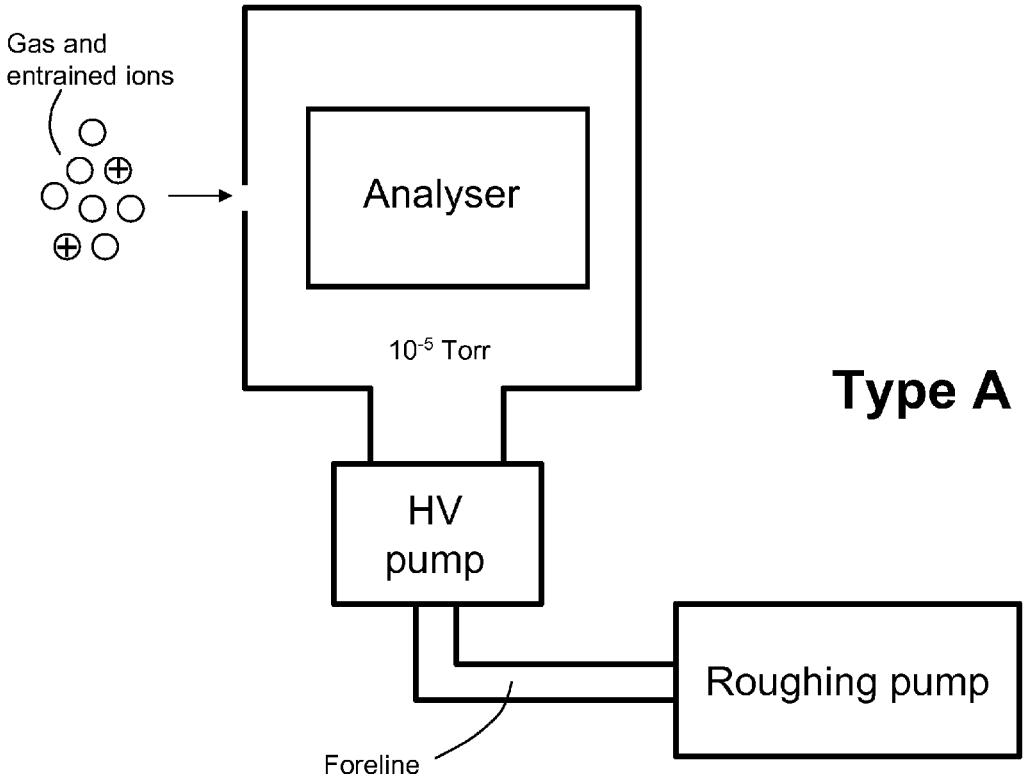
PRIOR ART Fig. 1.
FIG. 1 shows a prior art single stage system in which gas and entrained ions pass directly into the vacuum chamber containing the mass analyser from the API source.
Figure 2:
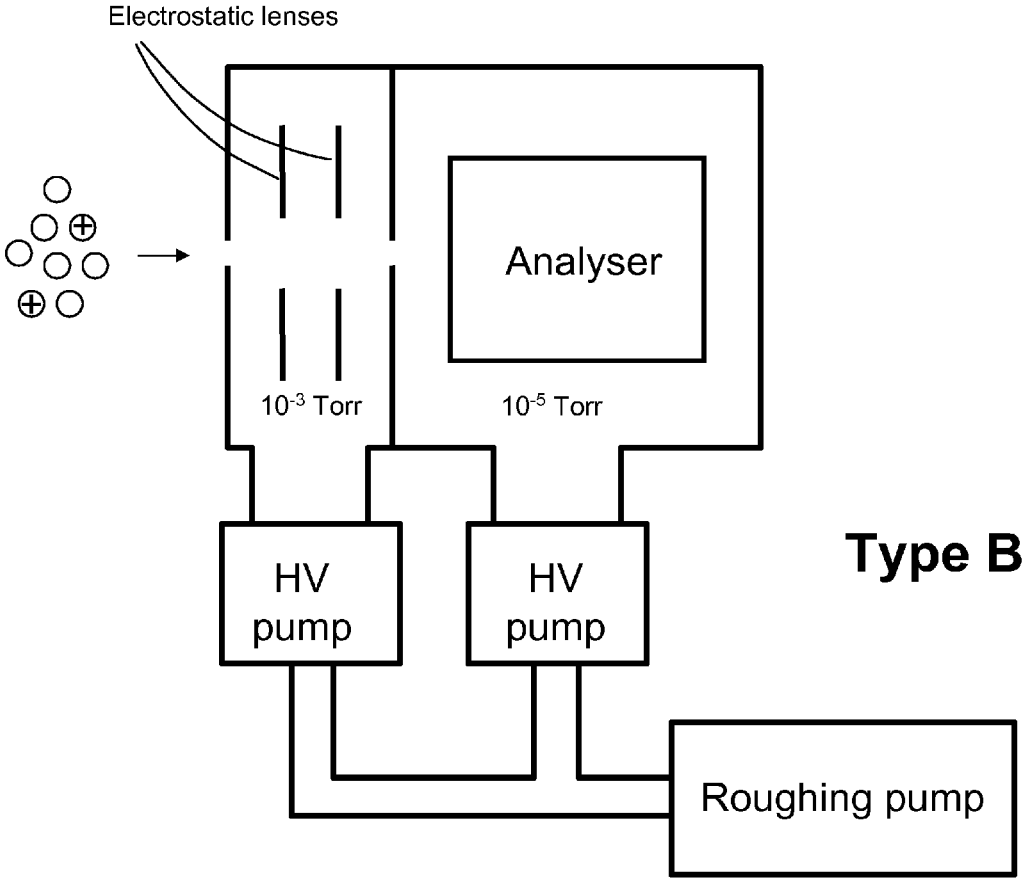
PRIOR ART Fig. 2.
FIG. 2 shows a prior art differentially pumped system in which the tasks of pumping the gas load and maintaining the mass analyser at a low pressure are partly separated, and electrostatic ion optics are used to focus the ions towards the aperture separating the two chambers.
Figure 3:
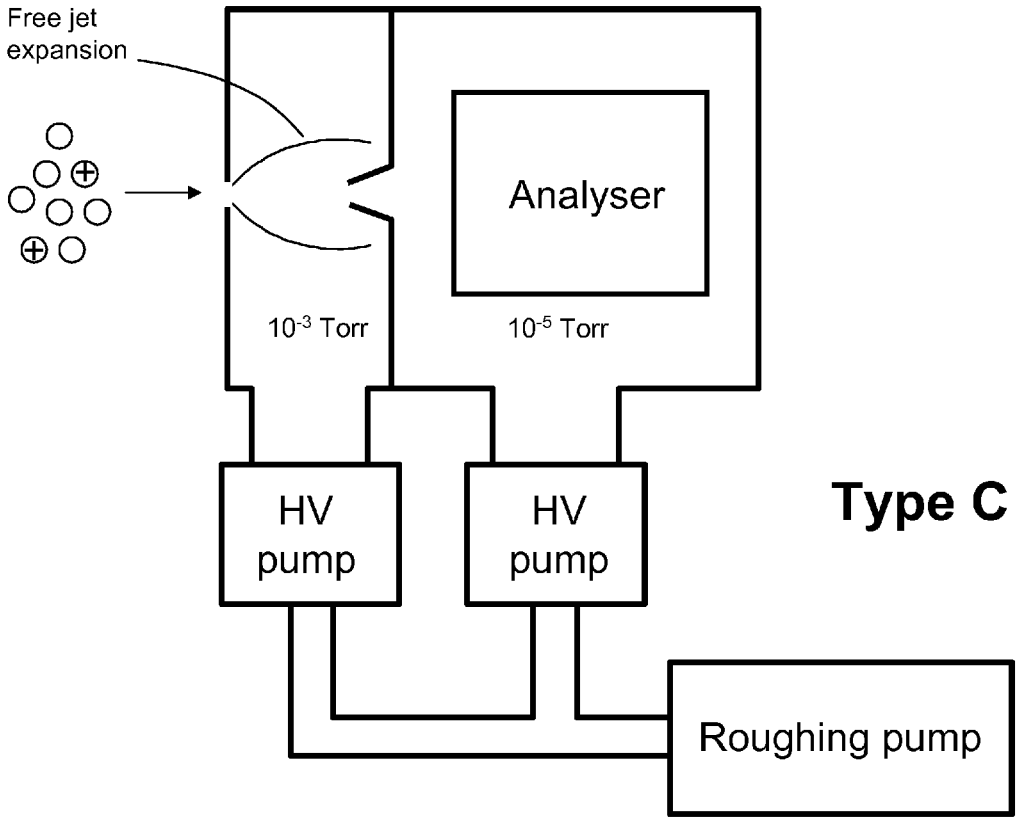
PRIOR ART Fig. 3.
FIG. 3 shows a prior art differentially pumped system in which a skimmer samples gas and entrained ions from the centre of the initial free jet expansion, in accordance with molecular beam methodology.
Figure 4:
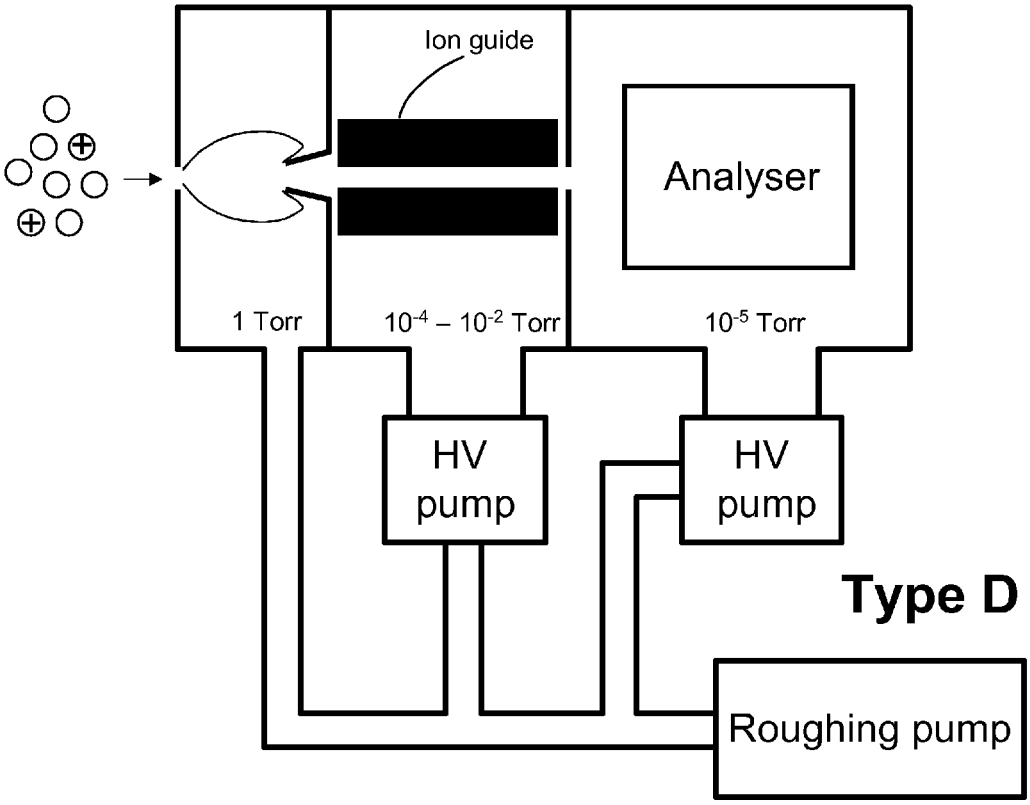
PRIOR ART Fig. 4.
FIG. 4 shows a prior art differentially pumped system in which the trajectories of the ions are confined within an rf ion guide as they transit the second vacuum chamber.
Figure 5:
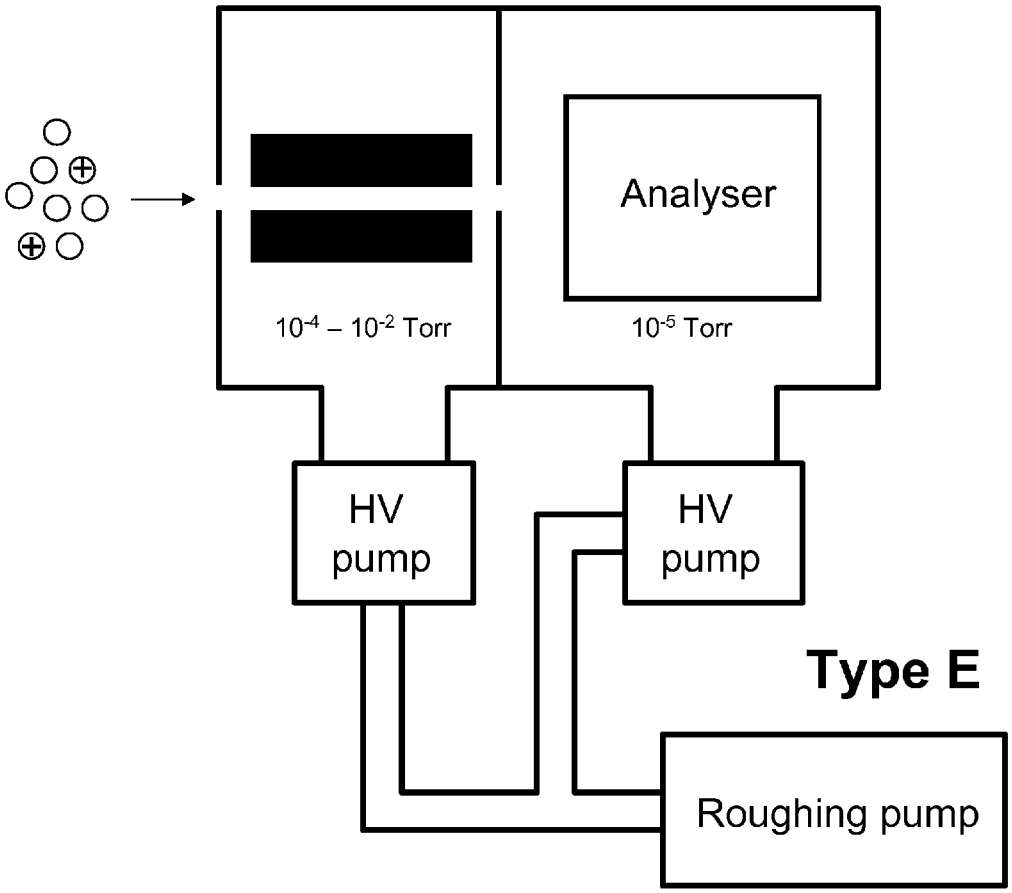
PRIOR ART Fig. 5.
FIG. 5 shows a prior art differentially pumped system in which the trajectories of the ions are confined within an rf ion guide as they transit the first vacuum chamber.
Figure 6:
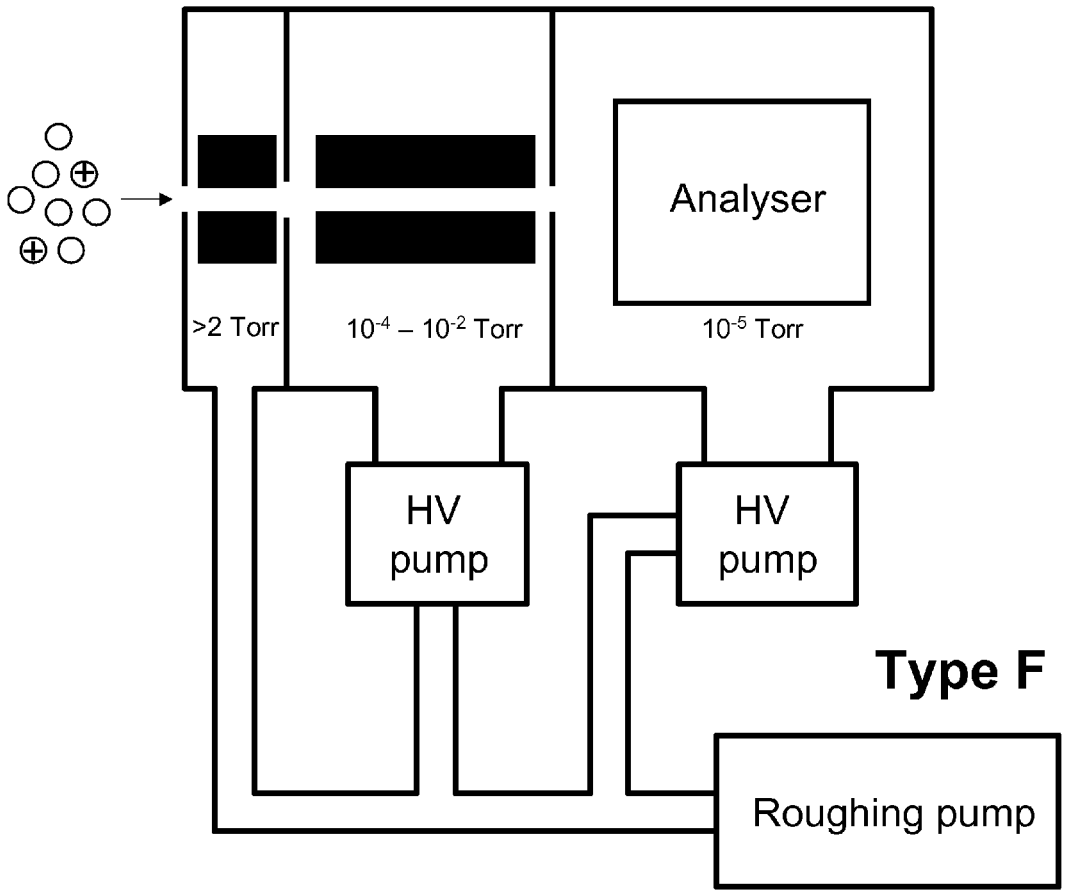
PRIOR ART Fig. 6.
FIG. 6 shows a prior art differentially pumped system in which ions are captured and focused by a high pressure rf ion guide after they emerge from the inlet aperture.
Figure 7:
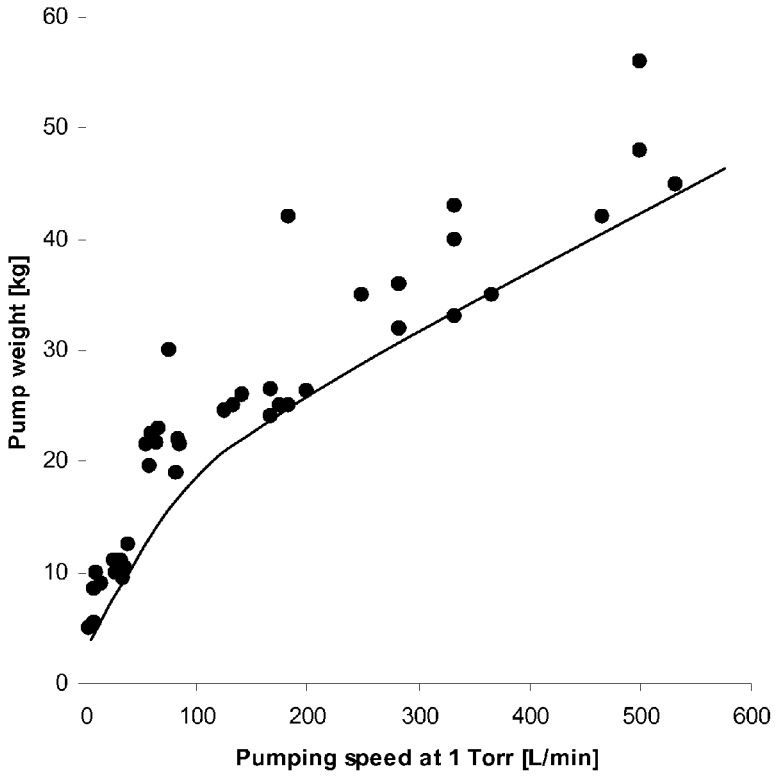
PRIOR ART Fig. 7.
FIG. 7 shows a plot of pump weight against pump speed at 1 Torr for a range of commercially available rotary vane, scroll, and piston pumps.

Recalling that for a miniature system, all the pumps, including the roughing pump, are desirably housed within a single enclosure, it is clear that a Type D instrument will be significantly heavier than a Type E instrument. The reason for this is that the weight of the roughing pump needed to pump the first vacuum chamber in the Type D architecture scales very unfavourably. According to common practice, the optimum pressure for operation of the first vacuum chamber is approximately 1 Torr. In FIG. 7, the weights of commercially available roughing pumps (rotary vane, scroll, and piston pumps) have been plotted against their pumping speeds at 1 Torr. When the inlet flow is reduced from 600 to 50 sccm, the weight of the required roughing pump is reduced from 35 kg to approximately 10 kg. Consequently, a great deal of signal has to be sacrificed in order to achieve a modest reduction in the size of the roughing pump. Complications arising from attempting to operate the first stage of a Type D instrument at pressures higher than 1 Torr include:

(a) The electrostatic optics used to focus ions towards the skimmer inlet or draw ions through the sampling orifice become less efficient due to the increased influence of scattering and viscous flow.

(b) The sampling or skimmer orifice must be made smaller to limit the flow of gas into the next vacuum stage, if the operating pressure of the ion guide and the pumping speed of the second stage pump are to be kept the same.

(c) If a skimmer is used to pierce the Mach disc of the free jet expansion, avoiding shock structures that disrupt the continuum flow of the jet becomes increasingly difficult and demands a precisely machined skimmer profile.

In the Type E architecture there are no regions that need to be at or near a pressure of 1 Torr, and advantage can be taken of the availability of small, lightweight, diaphragm pumps. For most pumps, the pumping speed decreases to a negligible value as the pressure approaches the ultimate or lowest pressure achievable with the pump. Rotary pumps are typically capable of an ultimate pressure in the range $5\times10^{-3}$-$1\times10^{-2}$ Torr, and can achieve nearly their full nominal pumping speed at 1 Torr. In contrast, the ultimate pressure possible with a diaphragm pump is generally not lower than 2-5 Torr, and full nominal pumping speed is approached at pressures in excess of 10-20 Torr. Consequently, diaphragm pumps are unsuitable for pumping large volumes of gas at or near a pressure of 1 Torr. However, small turbomolecular high vacuum pumps are available with Holweck drag stages that allow them to operate with foreline pressures in the range of 10-30 Torr. Diaphragm pumps are, therefore, ideal for use as backing pumps for these turbomolecular pumps. Referring to Eq. 1, it will be appreciated that for a given gas load, the foreline pumping speed can be reduced by a factor of ten if the operating pressure is increased from 1 Torr to 10 Torr.

The inventors have recognized that although a Type E architecture is highly unattractive for systems of a conventional size, for miniature systems, it is a viable and advantageous solution. This advantageous selection of a previously discounted architecture for a specific set of conditions arises from an insight by the present inventors of the unique set of conditions that arise in miniature systems.

Figure 8:
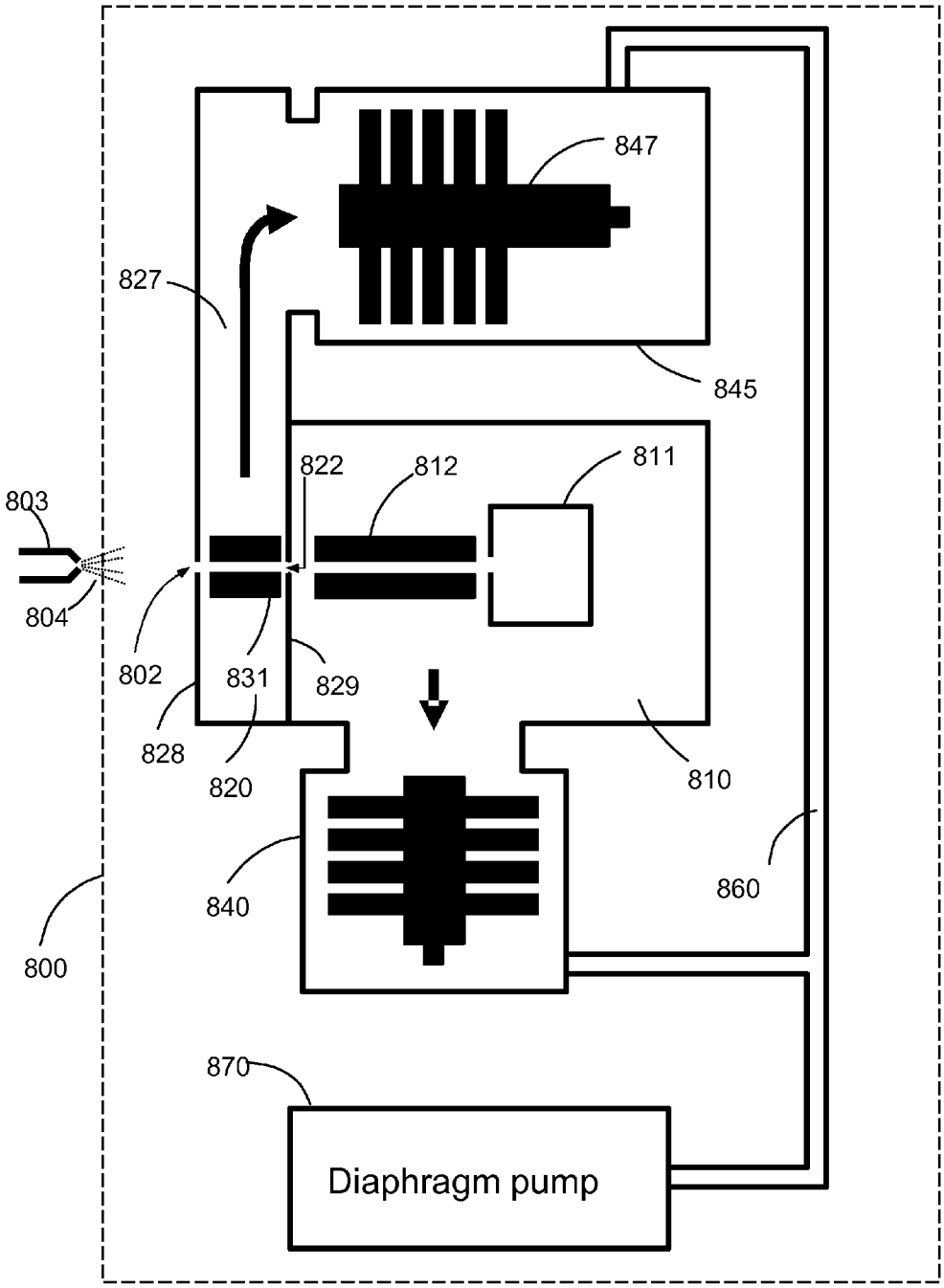
FIG. 8 shows a schematic representation of an exemplary embodiment in accordance with the present teaching.

FIG. 8 shows a schematic representation of an exemplary embodiment of the invention. Within the context of the present teaching an atmospheric pressure ion source 803 is used to generate ions. An ion source within the present teaching may comprise one or more of electrospray ionisation (ESI), microspray ionisation, nanospray ionisation, chemical ionisation (CI), matrix assisted laser desorption ionisation (MALDI), atmospheric pressure photoionisation (APPI), glow discharge ionisation, direct analysis in real time (DART) or derivatives thereof. Within the present context derivative thereof includes secondary electrospray ionisation (SESI), atmospheric pressure chemical ionisation (APCI), and desorption electrospray ionisation (DESI).

The ion source 803 operably provides gas and entrained ions 804 which are drawn through an inlet orifice 802 into an ion guide chamber 820, a first vacuum chamber of the system. The ions are directed by a miniature quadrupole ion guide 831 within this chamber 820 towards an aperture 822 that couples the first vacuum chamber 820 and a mass analyser chamber 810, a second vacuum chamber within which a mass analyser 812 is provided. The first chamber 820 is pumped to a pressure of $1\times10^{-3}$ to $5\times10^{-2}$ Torr by a turbomolecular pump 845 while the second chamber 810 is pumped to a pressure of $1\times10^{-6}$ to $1\times10^{-3}$ Torr by a second turbomolecular pump 840. Foreline pumping for both turbomolecular pumps is provided by a diaphragm pump 870 via a vacuum hose 860. It will appreciated that the performance of a single rf ion guide within a single chamber may be replicated by two or more individual rf ion guides each provided in their own chambers.

The ions that pass through the aperture 822 are filtered according to their mass-to-charge ratio by, in this exemplary arrangement, a quadrupole mass filter 812 and then detected using a suitable detector 811. It will be appreciated by someone of skill in the art that other mass filters and analysers may be used. These include, but are not restricted to, cylindrical, toroidal, Paul, and rectilinear ion traps, filters using crossed electric and magnetic fields, magnetic sector analysers, and time-of-flight analysers. The mass filter or analyser is also of a size that may be considered miniature in order that the overall size of the instrument is minimised, and also because such analysers and filters generally tolerate a high operating pressure.

Although not shown in the schematic, the quadrupole mass filter is desirably operably connected to a power supply that generates waveforms comprising of direct current (dc) and rf components. Desirably, the ion guide is capacitively coupled to the same supply such that only the rf components are applied to the rods. A fixed dc bias may be applied to all four rods of the ion guide through large resistors. As the waveform amplitude is scanned during the course of acquiring a mass spectrum, a fixed fraction of the rf component is applied to the ion guide. This fraction is determined by the network comprising the decoupling capacitor, the bias resistor, and stray capacitances. Alternatively, the ion guide may be connected to an independent supply that generates an rf waveform of fixed amplitude.

The maximum resolution achievable with a quadrupole mass filter is limited by the number of rf cycles that the ions experience while in the filter. Typically, a filter of conventional size is operated at approximately 1 MHz. In order to achieve the same resolution, miniature quadrupole filters must be operated at a higher frequency in order to compensate for the shorter rod length.

The inlet orifice 802 and the aperture 822 are desirably electrically isolated such that these components, as well as the ion guide 831, mass filter 812 and detector 811, may be individually biased. These biases may then be tuned to optimise the ion transmission, induce collisions to effect declustering, and set the ion energy.

In a miniature system, the length of the ion guide 831 may well be less than the diameter of the pump 845. When this is the case, there are three arrangements consistent with the teachings of this invention:

(a) The pump 845 may be placed as shown in FIG. 8 with the axis of the rotor 847 lying parallel to the axis of the ion guide 831. The duct 827 connecting the first chamber 820 to the pump 845 is desirably rectangular in section, and has a width approximately equal to the length of the ion guide 831 and a height approximately equal to the diameter of the pump.

(b) The pump 845 may be placed with the axis of the rotor 847 lying perpendicular to the axis of the ion guide 831 and connected to the vacuum chamber 820 using a hollow conic, square pyramidal or rectangular pyramidal frustrum.

(c) The pump 845 may be placed with the axis of the rotor 847 lying perpendicular to the axis of the ion guide 831 and connected directly to the first chamber 820 without a reducing connector. In this case, the distance between the outer wall 828 and the opposing bulkhead 829 must be greater or equal to the diameter of the pump. In order that the trajectories of the ions are confined during transit of the first chamber, either the inlet or the mass filter, or both the inlet and mass filter must be allowed to be re-entrant. This may be achieved, for example, by shaping the outer wall, or the bulkhead, or both the outer wall and bulkhead such that they have top-hat profiles.

It will be appreciated that in the arrangement of FIG. 8 the system is a two vacuum chamber system comprising first and second vacuum chambers, each being pumped at a pressure lower than about $5\times10^{-2}$ Torr. Each of the vacuum chambers and their associated pumps are desirably dimensioned and orientated relative to one another to fit within a single casing or housing 800 that may be provided as a benchtop instrument.

Figure 9:
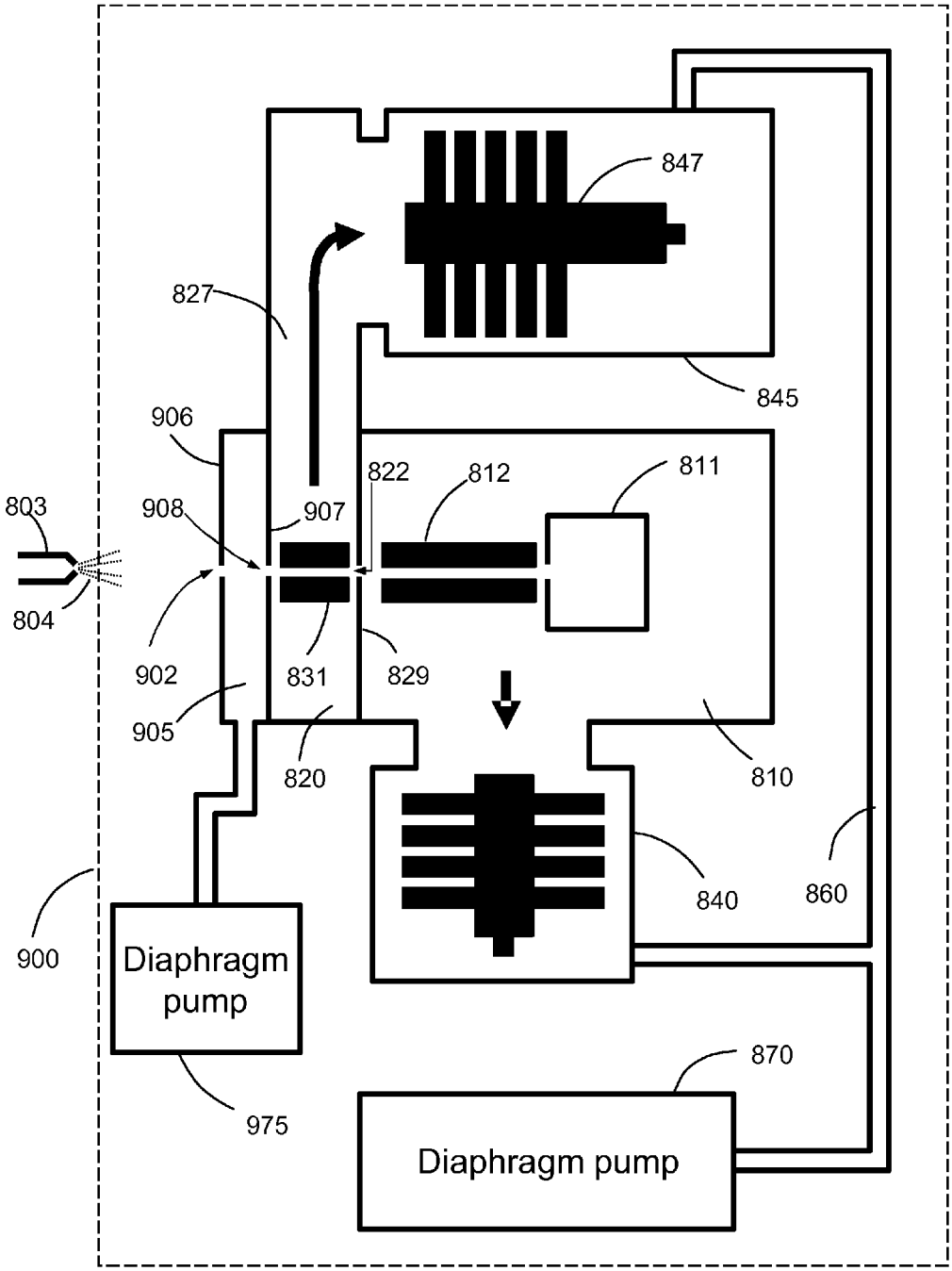
FIG. 9 shows a schematic representation of a second exemplary embodiment in accordance with the present teaching.

FIG. 9 shows a schematic representation of a second exemplary embodiment of the invention. It will be appreciated that this arrangement differs from that of FIG. 8 in that an additional chamber 905 is provided upstream of the ion guide. This chamber 905 is operably provided at a pressure much higher than conventionally encountered in vacuum interfaces and may be used to partition the flow of gas and ions without departing from the spirit of the invention. It will be appreciated that this exemplary arrangement of a three chamber system comprises a first and a second chamber pumped at a pressure lower than about $5\times10^{-2}$ Torr and a third chamber pumped at a pressure of about 50 Torr. Where the present teaching provides an additional chamber to the rf ion guide and mass analyser chambers, then it will be appreciated that this additional vacuum chamber operates at pressures far in excess of what conventionally would have been known. The absence of a skimmer within the construct of a system in accordance with the present teaching also distinguishes from certain prior art configurations.

Where provided, this additional chamber is desirably constructed such that the distance between the first wall 906 and the second wall 907 is of the order of a millimetre, as described in co-assigned patent U.S. Pat. No. 7,786,434 (B2) and the Journal of Microelectromechanical Systems Vol. 19(6), 2010, 1430-1443. The system is configured such that ions 804 generated by an atmospheric pressure ionisation source 803 may be operably introduced through the vacuum interface 905 and the ion guide 831 prior to introduction to the mass filter 812 for analysis based on their mass-to-charge ratios, each of the vacuum interface, ion guide and mass spectrometer being provided within a casing 900. As shown in FIG. 9, at least the vacuum interface chamber 905 and ion guide are coupled to different pumps. In this exemplary instance, the interface chamber 905 is coupled to a diaphragm pump 975 whereas the ion guide is coupled to a turbomolecular pump 845.

In the case of a quadrupole ion guide, a saddle potential is generated at any instant in time by the voltages applied to the rods. The trajectories of ions are determined by the initial radial displacement and velocity, the rf phase as the ions enter the field, and a parameter, q, defined as $$q = \frac{4eV}{m\omega^2 r_0^2} \quad \text{(Eq. 2)}$$

where V and ω are the amplitude and frequency of the rf waveform, respectively, m is the mass of the ion, e is the charge of the ion, and $r_0$ is the field radius. Stable trajectories are periodic, and may be considered as a supposition of a high frequency micromotion and a lower frequency secular or macromotion. At values of q greater than 0.908, the trajectories are unstable, and the ions are discharged when they collide with a rod. At low values of q, the amplitude of the micromotion is small compared with the secular component, and the approximately sinusoidal trajectories can be considered as being characteristic of a harmonic oscillator.

Figure 10:
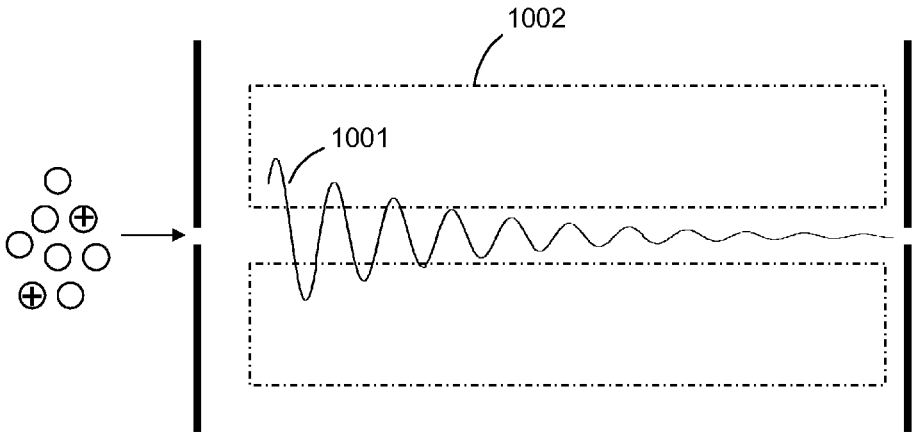
PRIOR ART Fig. 10.
FIG. 10 shows effect of collisional cooling on the ion trajectories within the ion guide, as described in the prior art.

Although the orientation of the saddle potential rotates rapidly in response to the applied rf waveforms, the ions behave as if trapped within a static potential well, usually referred to as a pseudopotential well in recognition of the fact that it is a time-averaged phenomenon. The amplitude of the sinusoidal trajectories represents the component of the total ion energy associated with radial motion. It is known that collisions between initially energetic ions and neutral gas molecules cause the ions to lose energy as they transit an ion guide. Consequently, the amplitude of the radial oscillations and the velocity in the axial direction steadily decrease, a process referred to as collisional cooling. If the number of collisions is sufficiently high, low energy ions accumulate close to the central axis and are able to exit the chamber through a small aperture. The emerging beam of low energy ions is ideally suited to mass analysis with a coaxial quadrupole filter, as ions with initial positions close to the central axis and small radial velocity components are preferentially transmitted, and higher resolution can be achieved when the axial velocity is low. The effect of collisional cooling on a typical ion trajectory is illustrated in FIG. 10. The radial excursions 1001 of an ion initially displaced far from the center line are shown steadily decreasing as the ion transits the ion guide 1002.

It is known from the prior art that, for a 15 cm long quadrupole ion guide constructed using 12.4 mm diameter rods, 90% of the ions are sufficiently cooled that they may pass through a 2.5 mm diameter aperture at the exit of the ion guide when the pressure is between approximately $6\times10^{-3}$ to $8\times10^{-3}$ Torr. Furthermore, the prior art teaches that the pressure required for maximum transmission can be extended to other lengths of ion guide through the relationship $P\times L\approx0.1$ Torr cm, where P is the pressure in the ion guide chamber and L is the length of the ion guide.

The inventors have discovered that at much lower P×L values than indicated by the prior art, most of the available ion flux may be transmitted through a 0.7 mm diameter aperture using a 2 cm long, miniature quadrupole ion guide constructed using 2.5 mm diameter rods. In addition, ions with initial axial energies of 30 eV are cooled to an extent that unit resolution can be achieved with a miniature quadrupole mass filter.

Figure 11:
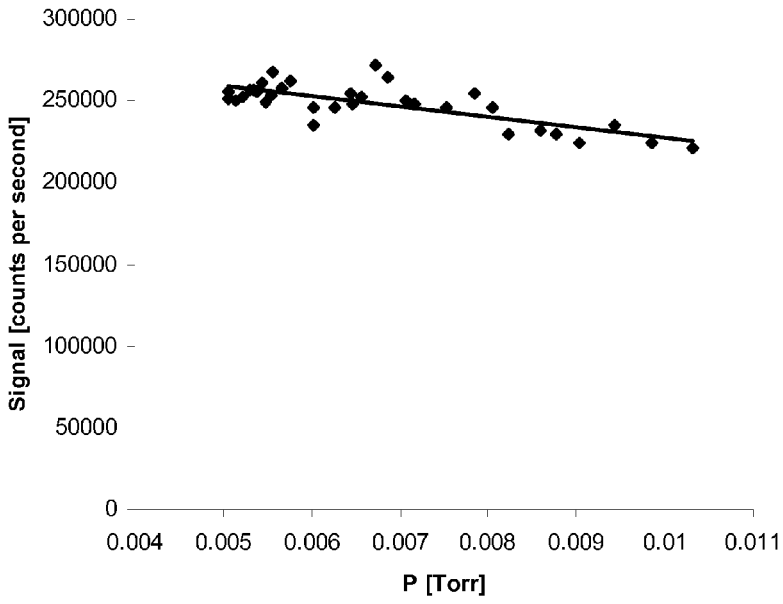
FIG. 11 shows how the signal level responds to pressure, as measured in the vicinity of the ion guide.

In FIG. 11, the signal level obtained using a 5 μg/ml solution of reserpine is plotted against the pressure measured close to the ion guide. The ion energy at the entrance of the ion guide was 10 eV, the quadrupole mass filter was operated at unit resolution, and the capacitive divider was set such that $q\approx0.5$ for the ion guide. The pressure was varied by bleeding air into the vacuum chamber through a leak valve mounted well away from the ion guide. There is a slight decrease in the signal level at m/z=609 as the pressure is increased.

The efficiency of ion transmission through the inter-chamber aperture was determined by comparing the current drain to earth from the electrically isolated inter-chamber aperture plate with the current drain to earth from a Faraday plate placed downstream from the aperture. Baseline corrections were made by biasing the ion guide at a high positive value. Although the quadrupole mass filter had to be removed, the amplitude of the rf waveform applied to the ion guide was set at a value consistent with analysis at m/z=609. Using this method, the transmission efficiency was found to be in excess of 80%.

Figure 12:
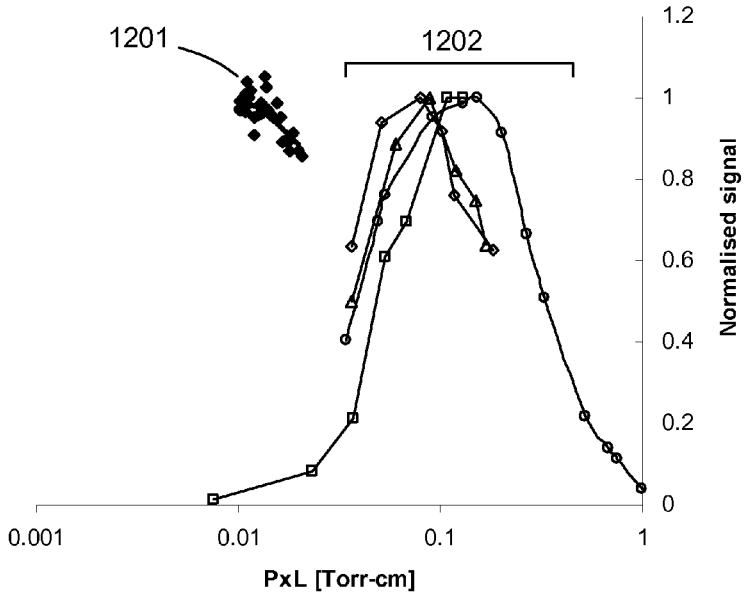
FIG. 12 shows the signal level plotted against the product of chamber pressure and ion guide length, together with data extracted from the prior art.

In FIG. 12, the signal level recorded using a miniature ion guide 1201 is plotted against P×L, so that the behaviour may be compared with a set of data extracted from the prior art 1202, which shows that the signal is expected to increase with increasing P×L until a transmission of close to 100% is reached at 0.1 Torr cm. On the basis of the prior art, the already high transmission efficiency at low P×L and the slight downward trend in signal level with increasing P×L observed with a miniature ion guide is, therefore, very unexpected.

Figure 13:
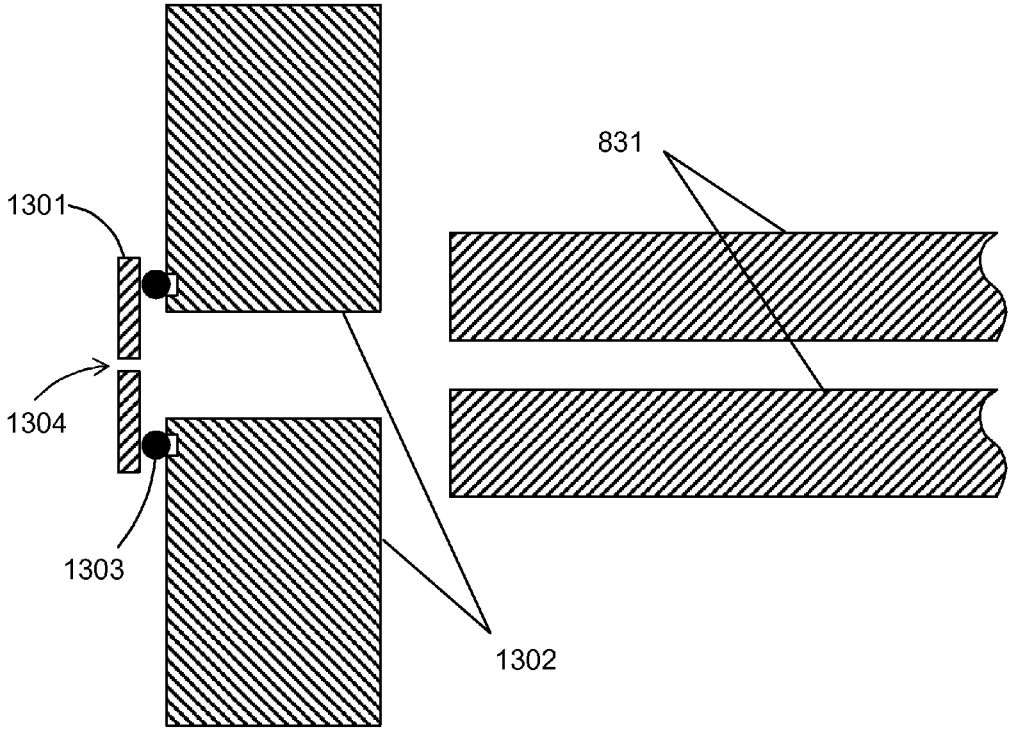
FIG. 13 shows how an inlet aperture may be mounted such that the individual components may be separately biased.
Figure 14:
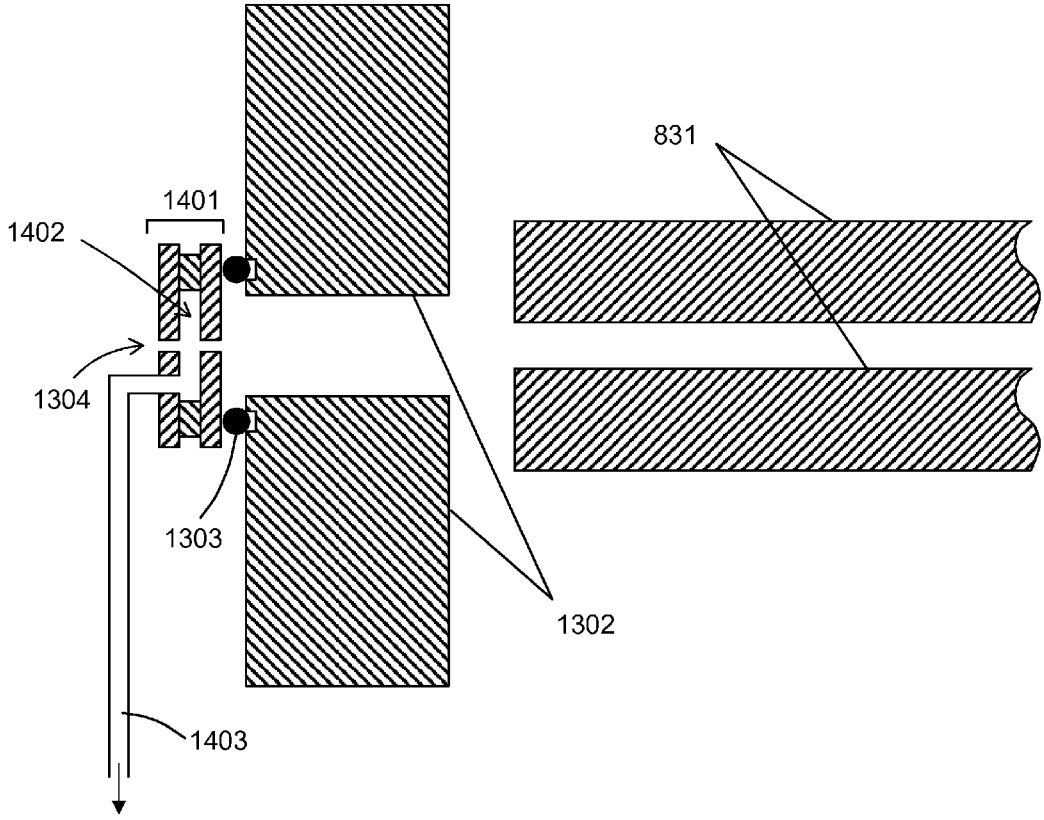
FIG. 14 shows how a differentially pumped, flow partitioning interface may be mounted such that the individual components may be individually biased.

An exemplary arrangement for supporting the inlet orifice plate is shown in FIG. 13. The inlet orifice plate 1301 is separated from the interface flange 1302 using a non-conducting spacer 1303, such that it may be electrically biased with respect to the interface flange. Ideally, the interface flange is also electrically isolated from the vacuum chamber so that it too can be separately biased. In operation, the aperture plate bias is desirably much higher than the interface flange bias. The initial kinetic energy of ions passing through the inlet orifice 1304 is determined by the difference between these two biases. If this is sufficiently high, collisions with neutral gas molecules cause any cluster ions formed during the initial free jet expansion to be broken up before entering the ion guide 831. A similar arrangement is shown in FIG. 14, except here the simple orifice plate has been replaced by a differentially pumped flow partitioning interface 1401. Some of the gas and entrained ions passing through the inlet orifice 1304 is pumped from the internal chamber 1402 via the vacuum hose 1403, desirably using a small diaphragm pump.

Figure 15:
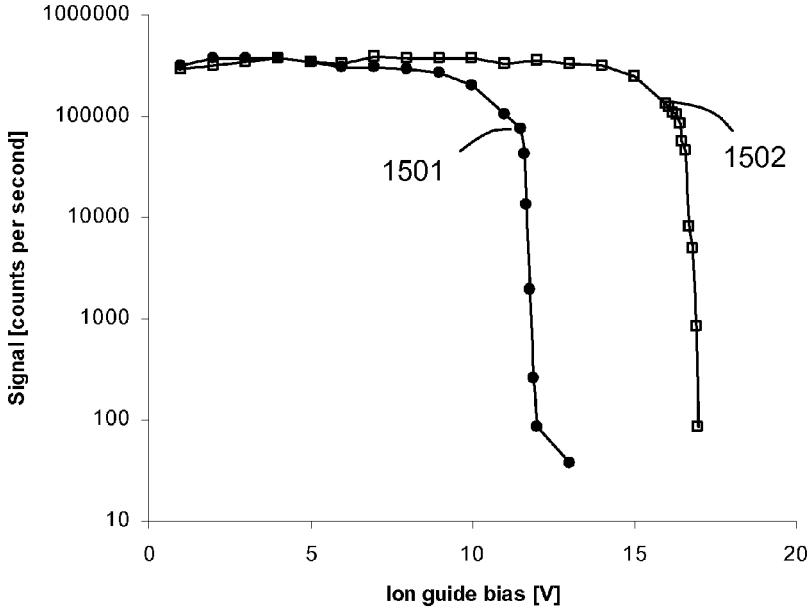
FIG. 15 shows how the signal level responds when a retarding bias voltage is applied to the ion guide.

The ion guide becomes a crude high pass filter when a retarding dc bias is applied to all four rods, as only ions with sufficient energy to overcome the potential barrier are transmitted. The approximate form of the ion energy distribution can be determined from a plot of signal level against the applied retarding bias. FIG. 15 shows how the signal level at m/z=609 responds as bias voltage is increased. One set of data 1501 corresponds to an interface flange bias of +10 V, whereas the other set of data 1502 corresponds to an interface flange bias of +15 V. In both cases the inlet orifice was held at a bias of 60 V higher than the interface flange, the inter-chamber aperture plate bias was set equal to the ion guide bias, and the quadrupole mass filter was biased at 1 V less than the ion guide. As the retarding bias required to attenuate the signal to a low level is approximately equal to the interface flange bias, it can be concluded that the latter sets the energy of the ions entering the ion guide.

Figure 16:
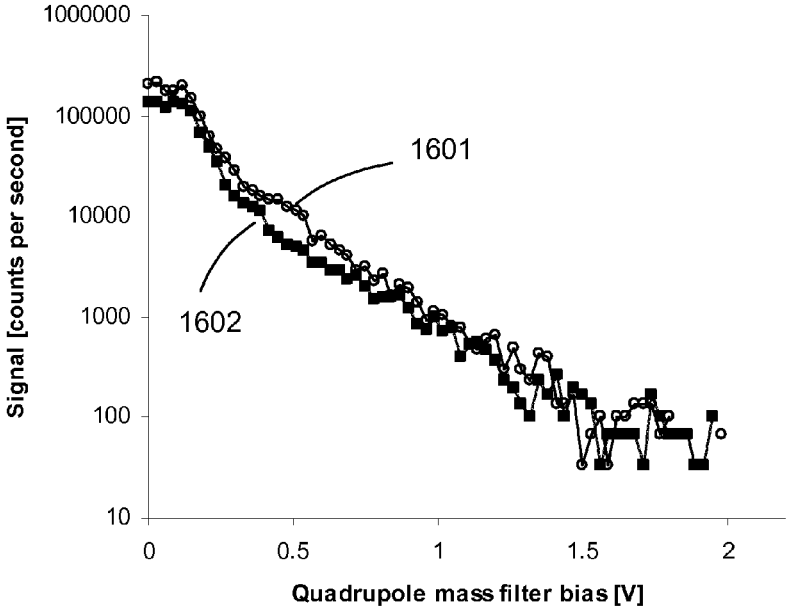
FIG. 16 shows how the signal level responds when a retarding bias voltage is applied to the analytical quadrupole, with the pressure in the vicinity of the ion guide set at two different values.

The same experiment was repeated using the quadrupole mass filter to determine the energy distribution of ions exiting the inter-chamber aperture. FIG. 16 shows how the signal level at m/z=609 responds as a retarding bias applied to the quadrupole mass filter is increased. One set of data 1601 corresponds to a pressure close to the ion guide of $5\times10^{-3}$ Torr, whereas the other set of data 1602 corresponds to a pressure close to the ion guide of $7\times10^{-3}$ Torr. The ion energy at the entrance to the ion guide was set at 10 eV by applying a bias of +10 V to the interface flange. As the retarding bias required to attenuate the signal is much less than 10V, it can be concluded that the energy of the ions has decreased significantly during transit of the ion guide. The absence of any further cooling when the pressure is increased from $5\times10^{-3}$ to $7\times10^{-3}$ Torr indicates that the benefits of collisional cooling can be fully realized at the lower pressure.

Figure 17:
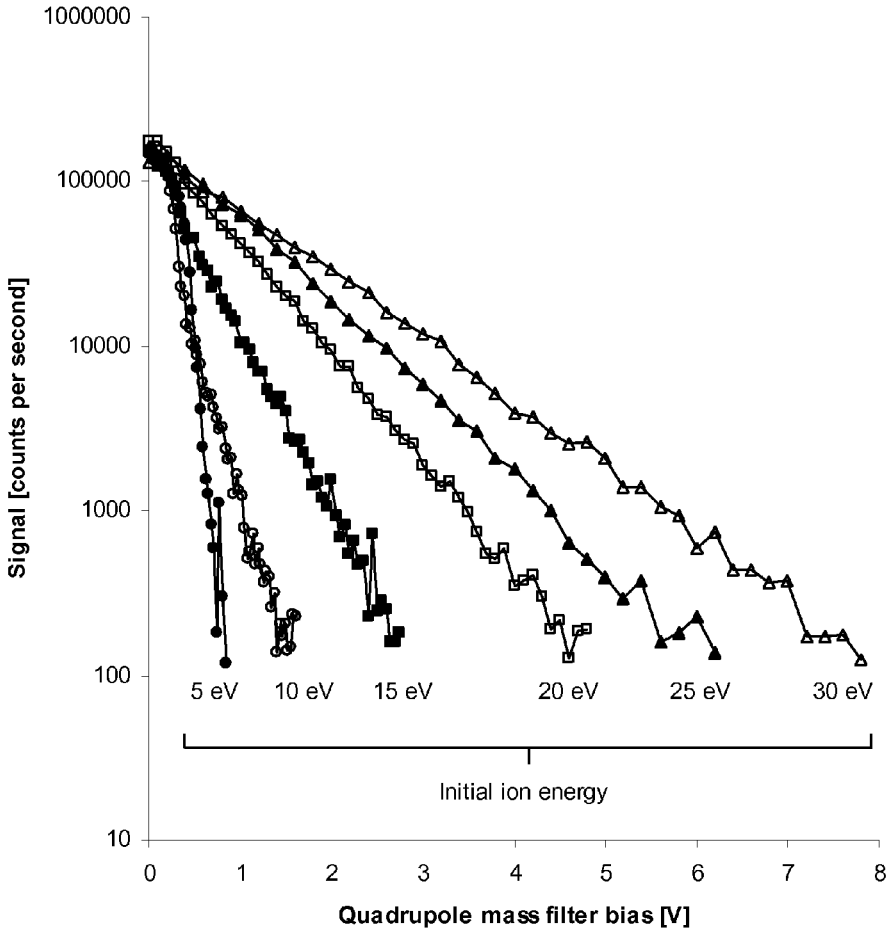
FIG. 17 shows how the signal levels corresponding to a range of different initial ion energies respond when a retarding bias voltage is applied to the analytical quadrupole.

The effect of changing the ion energy at the entrance to the ion guide is demonstrated in FIG. 17. As above, each set of data represents the response of the signal at m/z=609 to the retarding bias applied to the quadrupole mass filter. The ion energy in each case is as indicated, and the pressure close to the ion guide was $5\times10^{-3}$ Torr throughout. Even when the initial ion energy is 30 eV, 90% of the ions arriving at the quadrupole mass filter have less than 3 eV of energy. The ion energy is extensively reduced by collisional cooling at a P×L value of only 0.01 Torr cm.

Figure 18:
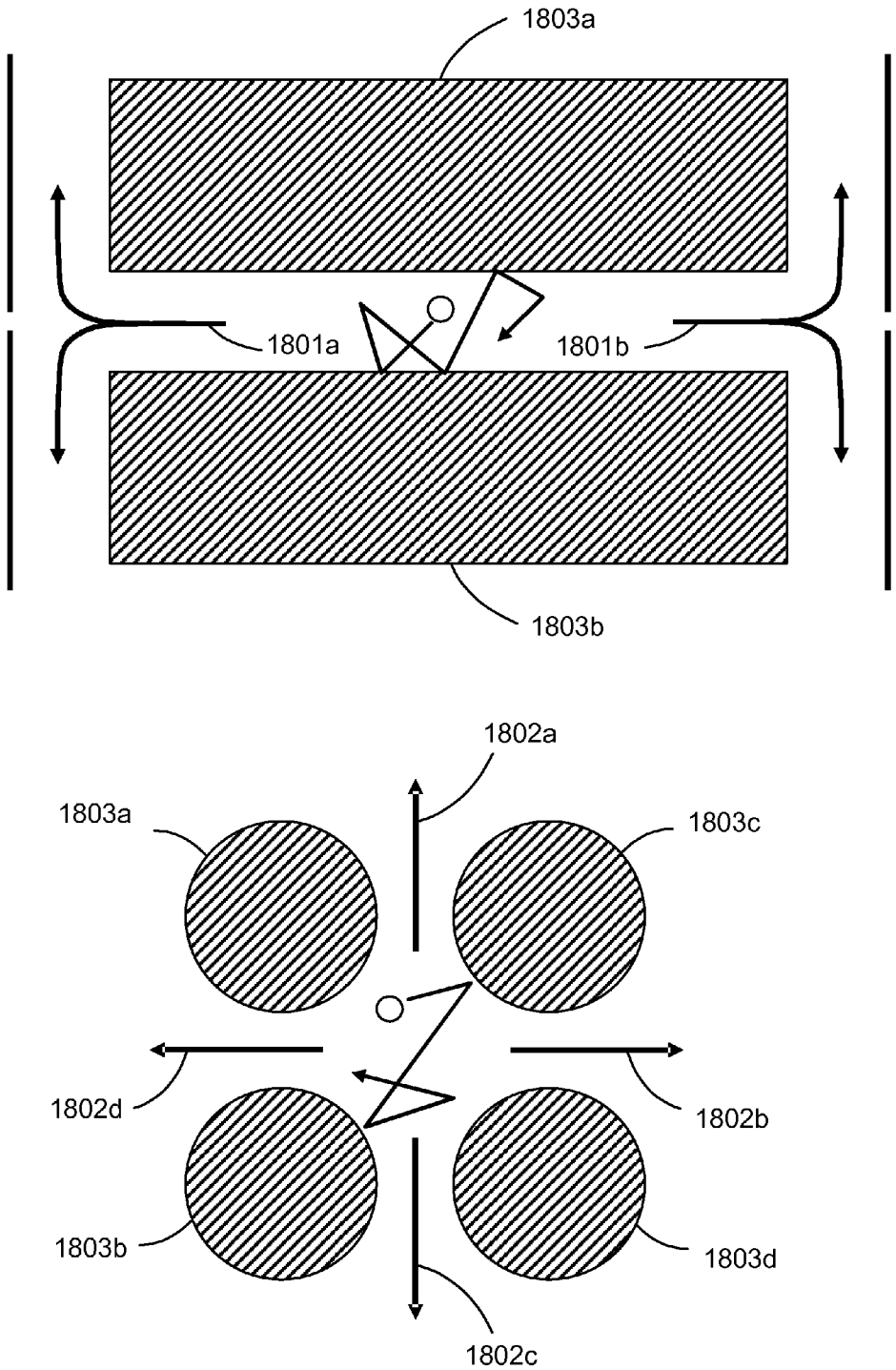
FIG. 18 shows how gas may escape from within the miniature quadrupole ion guide.

The flow of gas issuing from an orifice, such as 802 in FIG. 8 or 908 in FIG. 9, initially follows streamlines directed along an axis perpendicular to the plane of the orifice and into the ion guide. It will be understood by those of skill in the art that the thickness of the shock structures that define the boundaries of the initial free jet expansion are of the order of several local mean free path lengths. As a result, the shock bottle characteristic of expansion into regions at or near 1 Torr, becomes diffuse and ill-defined at lower pressures, particularly in view of the small dimensions of a miniature system. Inside the ion guide, collisions between molecules causes scattering. In addition, molecules collide with the surfaces of the four rods. As shown in FIG. 18, all of the gas injected into the internal volume of the ion guide must eventually leave through the entrance 1801*a*, exit 1801*b*, or gaps 1802*a-d* between the electrodes 1803*a-d*. Only a very small fraction passes through the small inter-chamber aperture. The local gas density is expected to decrease steadily along the length of the ion guide. In the case of a quadrupole ion guide, or indeed any multipole ion guide, the gaps between rods through which gas can escape are each assumed to present a conductance limiting rectangular aperture defined in one dimension by the length of the rods and in the other dimension by the closest distance between two adjacent rods. If the ion guide is a conventional quadrupole ion guide constructed using rods of length 15 cm and diameter 12.4 mm, as described in the prior art, gas can escape through a total area of approximately 27 $cm^2$. However, in the case of a miniature ion guide constructed, for example, using rods having a length of 2 cm and a diameter of 2.5 mm, the total area is only 0.73 $cm^2$. It will be appreciated that this rod length and diameter are exemplary of the dimensions of rods that may be used to construct a miniature ion guide. In accordance with the present teaching, the dimensions and geometry of the ion guide are such that apertures through which gas may escape from the ion guide have a total area less than 10 $cm^2$. Specific configurations may include dimensions such that the total area is less than 6 $cm^2$, and indeed dimensions such that the total area is less than 2 $cm^2$.

The evolution of the gas flow within a complex structure such as an ion guide can only be fully addressed through the use of suitable simulations. However, some aspects can be illustrated using the fundamental equations of gas flow in vacuum systems. In the molecular flow pressure regime, the conductance, C, of any plane aperture through which the gas may pass can be calculated using $$C=11.6A \quad \text{(Eq. 3)}$$

where A is the area of the aperture. Hence, to a first approximation, the conventional ion guide described above presents a total conductance between the source of gas and the pump of 313 L/s, whereas the miniature quadrupole ion guide described above presents a total conductance of only 8.5 L/s, which will be appreciated as being exemplary of miniature ion guides in general. Simulations or other calculations will yield estimates for the conductance of other ion guide designs, or indeed more accurate estimates for the conductance of a multipole ion guide. Nevertheless, in accordance with the present teaching, the dimensions and geometry of the miniature ion guide are such that gaps through which gas may escape present a conductance of less than 100 L/s. Specific configurations may include dimensions and geometries such that the total conductance is less than 10 L/s.

The flow of gas, Q, through the conductance is related to the difference between the upstream pressure, $P_1$, and the downstream pressure $P_2$ by $$Q=C(P_1-P_2). \quad \text{(Eq. 4)}$$

If the flow of gas through the inlet orifice is 0.93 Torr L/s as described in the prior art, and the background pressure in the chamber is $8\times10^{-3}$ Torr, then the approximate pressure within the conventional quadrupole ion guide is $1.1\times10^{-2}$ Torr, i.e. only marginally higher than the background pressure. However, in the case of the miniature ion guide, this increases to the much higher value of $1.2\times10^{-1}$ Torr, if the same gas flow is used. Based on these calculations, the inventors have realised that the teachings of the prior art can only be transferred to a miniature system if the gas flow is scaled with the size of the ion guide.

The inventors have also discovered that the convective flux from the inlet and the high pressure within the miniature ion guide results in significantly more flow into the mass analyser chamber 810 in FIG. 9 than would be expected based on the pressure measured in the vicinity of the ion guide. Consequently, the pumping speed of the pump 840 must be higher than anticipated. For a particular combination of inlet orifice, aperture, and pump sizes, the pressures measured during normal operation in the vicinity of the ion guide and in the mass analyser chamber were found to be $5.9\times10^{-3}$ Torr and $6.2\times10^{-5}$ Torr, respectively. When the convective flow from the aperture 908 was stopped (by blocking the inlet aperture 902), and the pressure in the vicinity of the ion guide was re-established at $5.9\times10^{-3}$ Torr by bleeding gas into the ion guide chamber 820 through a remote leak valve, the pressure in the mass analyser chamber 810 was only $4.7\times10^{-5}$ Torr. This demonstrates that the pressure in the mass analyser chamber increases from $4.7\times10^{-5}$ Torr to $6.2\times10^{-5}$ Torr solely as a result of the convective flux of gas from the first aperture 908 and the high gas pressure within the miniature ion guide. Given that the base pressure was $1.9\times10^{-5}$, this represents an increase of approximately 50%.

Figure 19:
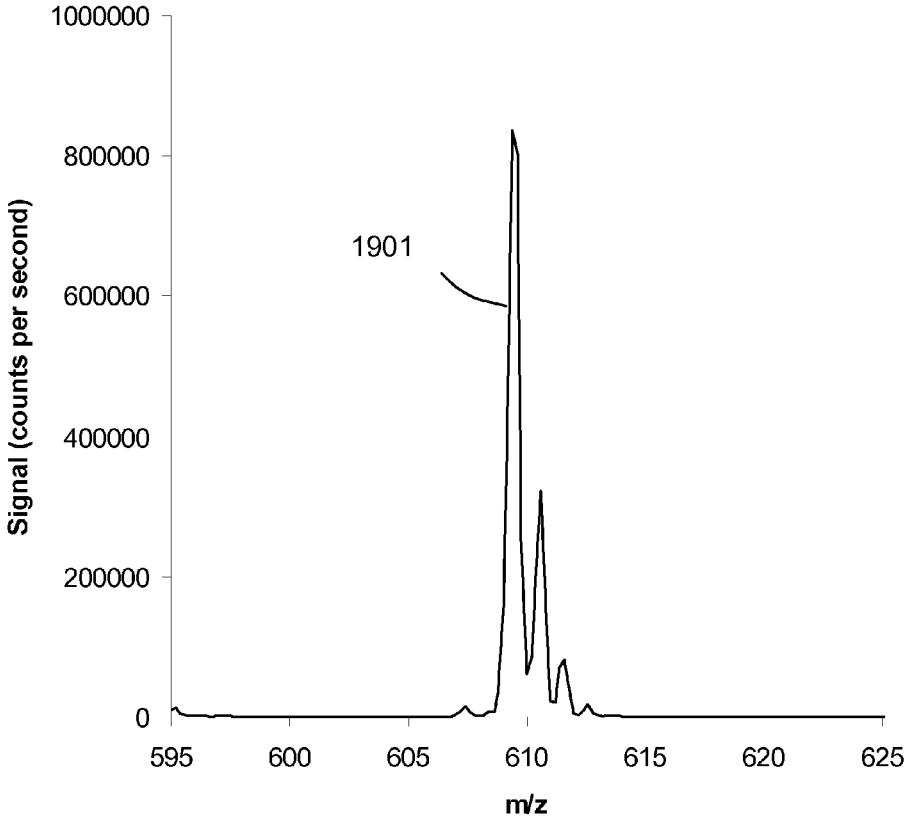
FIG. 19 shows a mass spectrum recorded using a system constructed according to the architecture described in connection with FIG. 9.

FIG. 19 shows a mass spectrum of reserpine, recorded using a system constructed according to the architecture described in connection with FIG. 9. The pressures in the vacuum chambers 905, 820, and 810 were approximately 100 Torr, $5\times10^{-3}$ Torr, and $5\times10^{-5}$ Torr, respectively. The entire system is contained within a single enclosure and weighs 27 kg, of which 7.5 kg can be attributed to the vacuum pumps.

While exemplary arrangements have been described herein to assist in an understanding of the present teaching it will be understood that modifications can be made without departing from the spirit and or scope of the present teaching. To that end it will be understood that the present teaching should be construed as limited only insofar as is deemed necessary in the light of the claims that follow.

Where the specifics of components usefully employed within the context of the present teaching have not been described herein, a miniature instrument, such as that described herein, may be advantageously manufactured using microengineered instruments such as those described in one or more of the following co-assigned US applications: U.S. patent application Ser. Nos. 30 12/380,002, 12/220,321, 12/284,778, 12/001,796, 11/810,052, 11/711,142 the contents of which are incorporated herein by way of reference. Within the context of the present invention the term microengineered or microengineering or micro-fabricated or microfabrication is intended to define the fabrication of three dimensional structures and devices with dimensions of the order of millimetres or less.

Furthermore, the words comprises/comprising when used in this specification are to specify the presence of stated features, integers, steps or components but does not preclude the presence or addition of one or more other features, integers, steps, components or groups thereof. Additionally, within the context of the present specification, the words first, second and third when used to describe vacuum chambers, refer only to the existence of specific individual ones of a plurality of chambers and not necessarily to their relative position with respect to the direction of ion travel.

What is claimed is:

1. A miniature mass spectrometer system comprising a plurality of vacuum chambers, the system further comprising:

a. an ion source operating substantially at atmospheric pressure and employing electrospray ionisation, microspray ionisation, nanospray ionisation, chemical ionisation, or derivatives thereof;

b. an rf ion guide provided within an ion guide vacuum chamber of the system, the ion guide defining a ion path between an entrance and exit to the ion guide vacuum chamber, the dimensions and geometry of the ion guide being such that apertures through which gas may escape from the ion guide have a total area less than 10 $cm^2$; and c. a mass analyser provided within a mass analyser vacuum chamber of the system;

wherein the vacuum chambers containing the rf ion guide and the mass analyser are operably pumped at a pressure lower than about $5\times10^{-2}$ Torr, other vacuum chambers of the system, where provided, being operably pumped at a pressure higher than about 50 Torr.

2. The system of claim 1 wherein each of the ion guide and mass analyser vacuum chambers is coupled to a pump, the effective pumping speed in the ion guide chamber being operably greater than the effective pumping speed in the mass analyser chamber.

3. The system of claim 1 wherein the apertures through which gas may escape from the ion guide have a total area less than 6 $cm^2$.

4. The system of claim 1 wherein the apertures through which gas may escape from the ion guide have a total area less than 2 $cm^2$.

5. The system of claim 1 wherein the ion guide is dimensioned and configured to provide a conductance of less than approximately 10 L/s.

6. The system of claim 1 wherein the ion guide is dimensioned and configured to provide a conductance of less than approximately 100 L/s.

7. The system of claim 1 wherein the ion guide has a length selected in combination with the operable pressure in the vicinity of the ion guide such that the product of the pressure in the vicinity of the rf ion guide and the length of the ion guide is greater than 0.01 Torr-cm.

8. The system of claim 7 wherein the ion guide chamber and the mass analyser chamber are separated by an aperture with operably more than 40% of the ions exiting the ion guide being transmitted through the aperture and into the next vacuum chamber.

9. The system of claim 1 wherein the ion guide has a length selected in combination with the operable pressure in the vicinity of the ion guide such that the product of the pressure in the vicinity of the rf ion guide and the length of the ion guide is greater than 0.01 Torr-cm and less than 0.02 Torr-cm.

10. The system of claim 9 wherein the ion guide chamber and the mass analyser chamber are separated by an aperture with operably more than 40% of the ions exiting the ion guide being transmitted through the aperture and into the next vacuum chamber.

11. The system of claim 8 wherein operably the average axial kinetic energy of ions that have passed through the aperture is substantially less than the injection energy into the ion guide.

12. The system of claim 2 wherein the pump coupled to each of the ion guide and mass analyser chambers is selected from one or more turbomolecular pumps with foreline pumping provided by one or more diaphragm pumps.

13. The system of claim 2 further comprising a housing, each of the ion guide and mass analyser chambers and the pump(s) coupled thereto being provided within the housing.

14. The system of claim 1 wherein the ion guide is a quadrupole ion guide.

15. The system of claim 1 wherein the ion guide is a multipole ion guide.

16. The system of claim 1 wherein the ion guide is a stacked ring ion guide.

17. The system of claim 1 wherein the mass analyser is a quadrupole mass filter.

18. The system of claim 1 wherein the mass analyser is an ion trap.

19. The system of claim 1 comprising a split-flow turbomolecular pump operably configured to pump the ion guide and mass analyser chambers.

20. The system of claim 1 wherein the ion guide chamber is pumped by a turbomolecular pump whose rotor axis is parallel to the central axis of the rf ion guide.

21. The system of claim 1 comprising a differentially pumped flow partitioning interface provided before the ion guide chamber.

22. The system of claim 1 further comprising a vacuum interface chamber provided upstream of the ion guide and mass analyser chambers, the system being configured such that ions generated by an atmospheric pressure ionisation source may be operably transmitted through the vacuum interface and the ion guide prior to introduction to the mass analyser.

23. The system of claim 1 configured such that the gas flow into the ion guide chamber is two orders of magnitude greater than the gas flow into the mass analyser chamber.

24. The system of claim 1 wherein each of the ion guide and mass analyser is operably connected to a waveform generator, the system being configured such that only the rf component is operably coupled to the ion guide.

25. The system of claim 1 comprising a second rf ion guide provided in a second ion guide chamber.

26. The system of claim 25 wherein the first and second rf ion guides are configured to replicate a single ion guide in a single chamber.

* * * * *